US011124985B1

(12) United States Patent
Felder

(10) Patent No.: US 11,124,985 B1
(45) Date of Patent: Sep. 21, 2021

(54) UMBRELLA ANCHORING SYSTEM

(71) Applicant: Goldia G. Felder, Jacksonville, FL (US)

(72) Inventor: Goldia G. Felder, Jacksonville, FL (US)

( * ) Notice: Subject to any disclaimer, the term of this patent is extended or adjusted under 35 U.S.C. 154(b) by 0 days.

(21) Appl. No.: 16/692,677

(22) Filed: Nov. 22, 2019

(51) Int. Cl.
*E04H 12/22* (2006.01)
*A45B 23/00* (2006.01)

(52) U.S. Cl.
CPC ..... *E04H 12/2223* (2013.01); *A45B 23/00* (2013.01); *A45B 2023/0012* (2013.01)

(58) Field of Classification Search
CPC ..... E04H 12/2223; E04H 12/223; E04H 12/2215; A45B 23/00; A45B 2025/003; A45B 2200/1009; A45B 2023/0012
See application file for complete search history.

(56) References Cited

U.S. PATENT DOCUMENTS 1,748,347 A * 2/1930 Horowitz ..... A45B 19/04 135/20.3
3,311,119 A * 3/1967 Pearlstine ..... A45B 17/00 135/20.3
3,316,983 A * 5/1967 Goodman ..... E21B 11/005 173/216
4,850,564 A * 7/1989 Padin ..... E04H 12/2223 248/533
5,152,495 A * 10/1992 Jacinto ..... E04H 12/2223 135/98
5,156,369 A * 10/1992 Tizzoni ..... E04H 12/2223 135/16
5,199,361 A * 4/1993 Robinson ..... E05B 73/00 109/50
5,396,916 A * 3/1995 Boissonnault ..... A45B 7/005 135/16
6,953,180 B1 10/2005 Ruvalcaba et al.
(Continued)

FOREIGN PATENT DOCUMENTS

FR 2632338 A1 * 12/1989 ..... A45B 23/00

OTHER PUBLICATIONS

Machine translation of foreign reference FR2632338, obtained from https://worldwide.espacenet.com/patent/search/family/009366874/publication/FR2632338A1?q=fr2632338 (last accessed on Jan. 20, 2021) (Year: 2021).*

*Primary Examiner* — Theodore V Adamos
(74) *Attorney, Agent, or Firm* — Sanchelima & Associates, P.A.; Christian Sanchelima; Alexander Rodriguez

(57) ABSTRACT

An umbrella anchoring system including an umbrella coupling unit assembly and a ground spike assembly is disclosed herein. The umbrella coupling unit assembly includes an upper umbrella coupling aperture including a locking mechanism to aid a user in securing an umbrella therein. Furthermore, the umbrella coupling unit assembly includes a lower aperture configured to receive the ground spike assembly therein. The ground spike assembly is securely mounted to a ground surface at a deep enough length to efficiently support an umbrella. Additionally, the umbrella anchoring system also includes a hand crank disposed on the umbrella coupling unit assembly to aid a user in securing the umbrella coupling unit assembly to the ground spike assembly. The umbrella anchoring system increases the safety of a user by providing increased protection to anchored umbrellas from strong winds.

9 Claims, 5 Drawing Sheets

(56) References Cited

U.S. PATENT DOCUMENTS

| | | | | |
|---|---|---|---|---|
| 8,991,108 | B1 * | 3/2015 | Zamrzla | B60T 7/12 52/157 |
| 9,149,012 | B1 * | 10/2015 | Sorensen | A01G 25/092 |
| 9,179,745 | B2 * | 11/2015 | Berland | A45B 3/00 |
| 9,629,427 | B1 * | 4/2017 | Alm | A45B 23/00 |
| 2004/0261827 | A1 * | 12/2004 | Chen | A45B 23/00 135/20.1 |
| 2007/0131824 | A1 * | 6/2007 | Harold | E04H 12/2223 248/156 |
| 2008/0092936 | A1 * | 4/2008 | Carabillo | A45B 25/00 135/16 |
| 2011/0036964 | A1 * | 2/2011 | Escola Puig-Corve | E04H 12/2269 248/545 |
| 2020/0131795 | A1 * | 4/2020 | Worm | E04H 12/2223 |

* cited by examiner

UMBRELLA ANCHORING SYSTEM

BACKGROUND OF THE INVENTION

1. Field of the Invention

The present invention relates to an umbrella anchoring system and, more particularly, to an umbrella anchoring system that includes an umbrella coupling unit assembly and a ground spike assembly to aid a user in easily securing an umbrella to a ground surface.

2. Description of the Related Art

Several designs for an umbrella anchoring system have been designed in the past. None of them, however, include an umbrella anchoring system comprising a ground spike with a threaded body. The system further including an umbrella coupling unit having an upper umbrella coupling aperture and a locking mechanism. Furthermore, the umbrella coupling unit includes a lower aperture with a threaded spike advancing mechanism that is operated by a hand crank Additionally, the hand crank is attached to the exterior of the coupling unit. It is known that individuals in a beach environment often secure beach umbrellas to a ground surface in order to provide protection from the sun. It is also known that a beach environment may include harsh winds that may blow away the previously secured umbrellas. These umbrellas that have been blown away present a danger to individuals that inhabit the beach environment. The loose umbrellas may act as projectiles that may seriously injure an individual. Therefore, there is a need for a suitable umbrella anchoring system.

Applicant believes that a related reference corresponds to U.S. Pat. No. 6,953,180B1 issued for an anchoring device for an umbrella for driving and securing the umbrella to a ground surface such as one comprised of sand or dirt. The anchoring device includes a base plate that has an upper and a lower side. The device further includes a stake member mounted to the lower side of the base plate to provide a removably penetrating surface. Additionally, a tubular member is coupled to the upper side of the base plate. However, it differs from the present invention because the U.S. Pat. No. 6,953,180B1 reference fails to include an efficient method for a user to secure a stake member to an umbrella coupling unit. The reference comprises a complicated configuration that is not efficient for a user to use. The present invention addresses these issues by providing an umbrella coupling unit assembly and a ground spike assembly that is efficient and easily mounted to a ground surface. Additionally, the umbrella coupling unit assembly includes a hand crank to aid a user in efficiently securing the umbrella coupling unit assembly to the ground spike assembly.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide an umbrella anchoring system that aids a user in easily securing an umbrella to a ground surface.

It is another object of this invention to provide an umbrella anchoring system increases the safety of a user by providing a secure attachment for umbrellas that will not be blown away by strong winds.

It is still another object of the present invention to provide an umbrella anchoring system that includes a hand crank to allow a user to easily secure an umbrella coupling unit assembly to a ground spike assembly.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
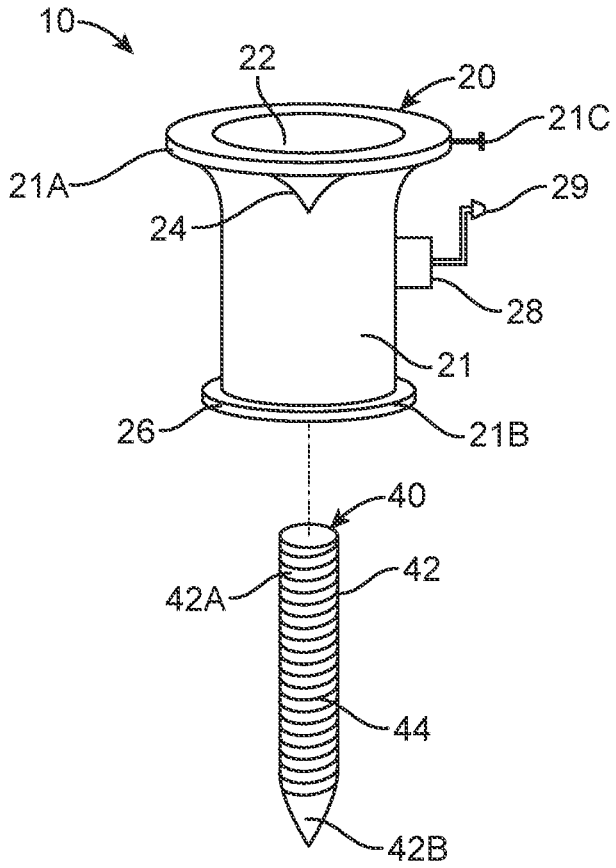
FIG. 1 represents an exploded view of an umbrella anchoring system 10 wherein an umbrella coupling unit assembly 20 and a ground spike assembly 40 may be viewed in accordance to an embodiment of the present invention.
Figure 2:
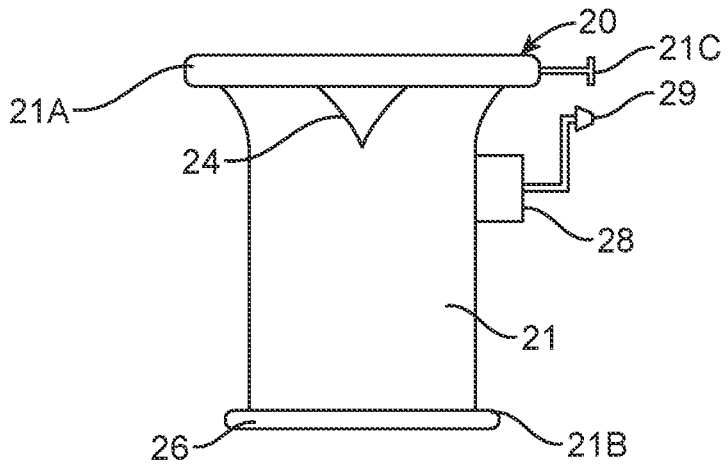
FIG. 2 shows a front view of umbrella coupling unit assembly 20 in accordance to an embodiment of the present invention.
Figure 3:
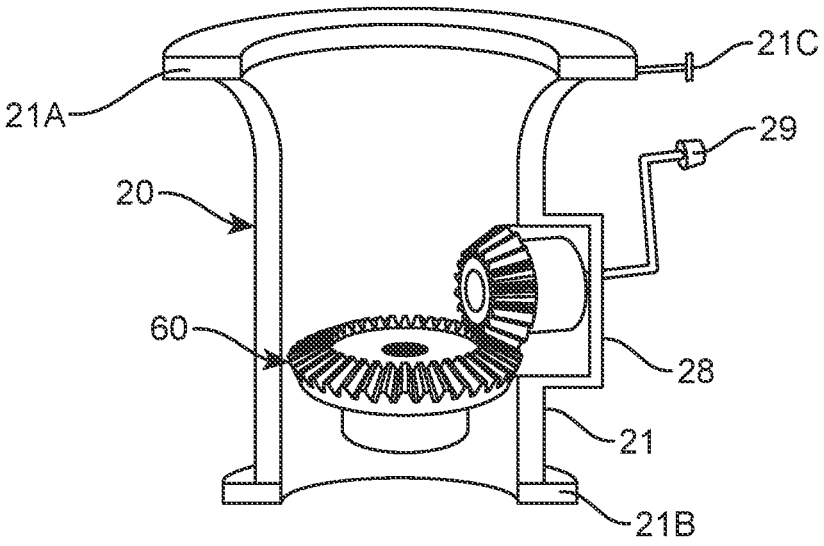
FIG. 3 illustrates an internal view of umbrella coupling unit assembly 20 having gear assembly 60 mounted therein in accordance to an embodiment of the present invention.
Figure 4:
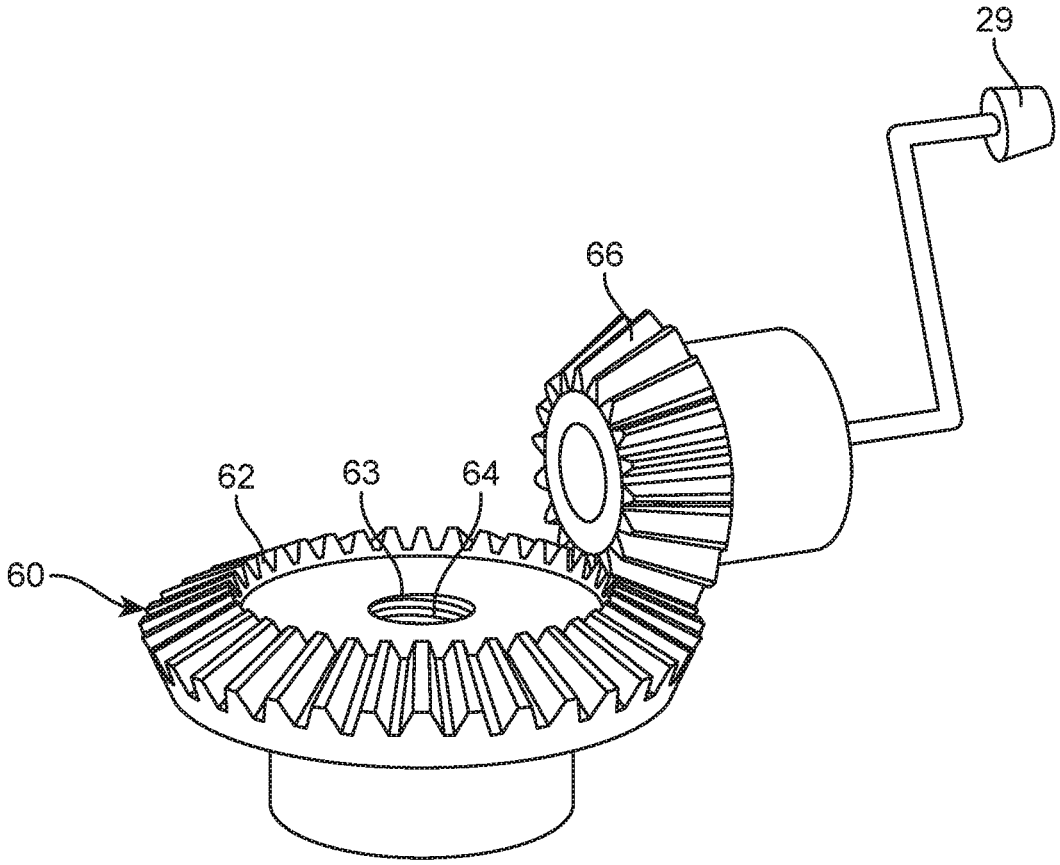
FIG. 4 is a representation of an isometric view of gear assembly 60 in accordance to an embodiment of the present invention.
Figure 5:
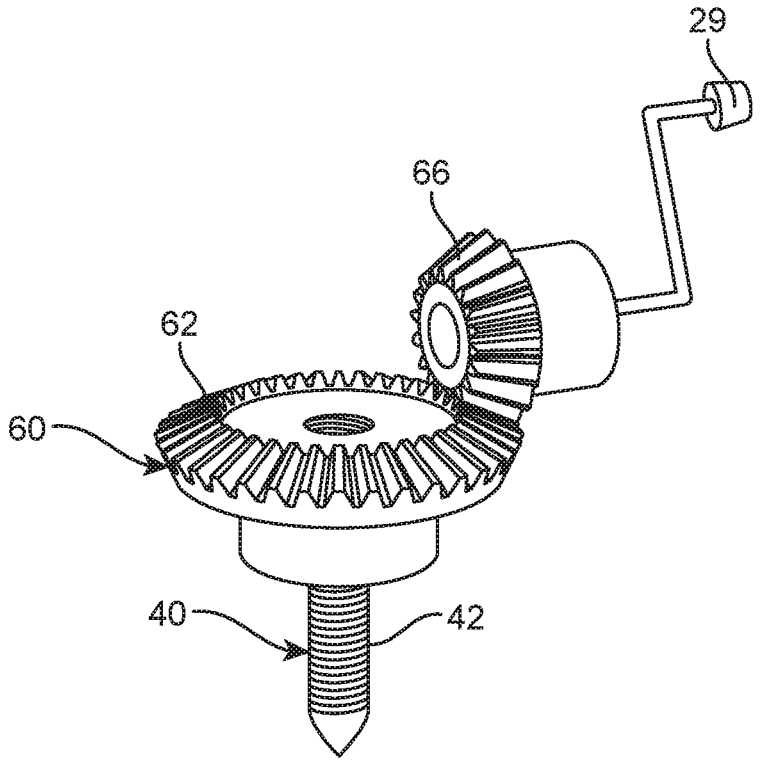
FIG. 5 shows an isometric view of gear assembly 60 having ground spike assembly 40 mounted therein in accordance to an embodiment of the present invention.
Figure 6:
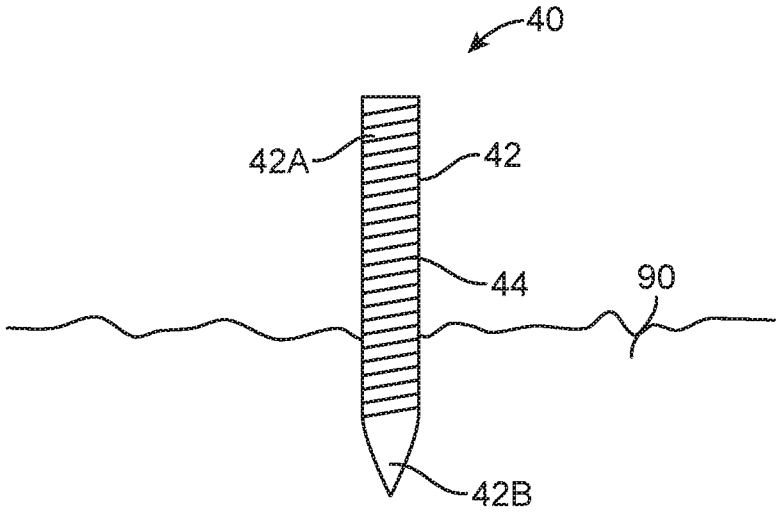
FIG. 6 illustrates a front view of ground spike assembly 40 secured within a ground surface 90 in accordance to an embodiment of the present invention.
Figure 7:
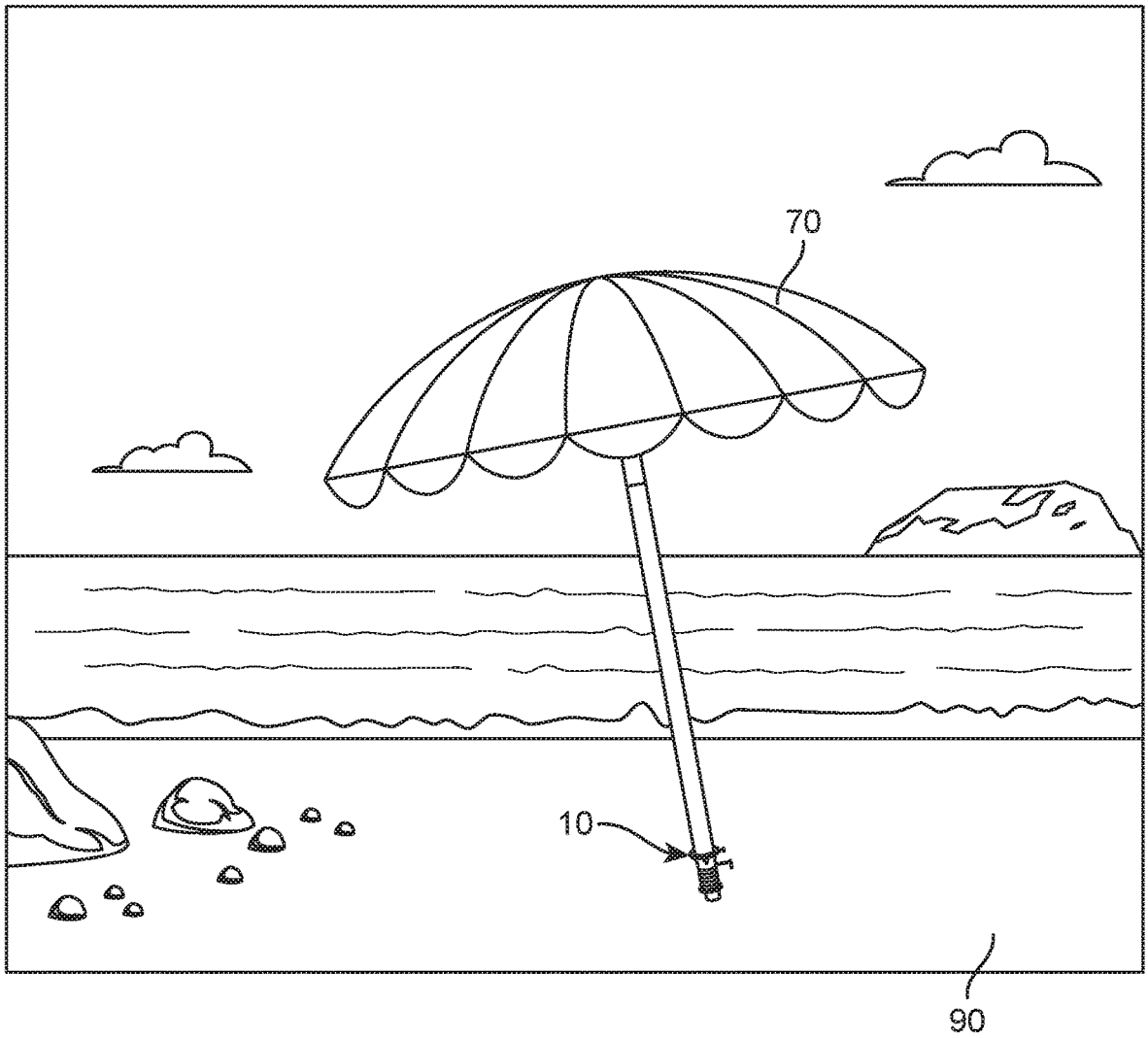
FIG. 7 is a representation of an isometric view of umbrella anchoring system 10 in use wherein an umbrella 70 is mounted using the system in accordance to an embodiment of the present invention.

Referring now to the drawings, where the present invention is generally referred to with numeral 10, it can be observed an umbrella anchoring system that basically includes an umbrella coupling unit assembly 20 and a ground spike assembly 40, a gear assembly 60, a ground surface 90, and an umbrella 70.

Umbrella coupling unit assembly 20 includes an umbrella coupling body 21 having an upper umbrella coupling aperture 22 and a lower aperture 26. Umbrella coupling body 21 may be of any suitable material to provide the necessary protection against strong winds. This material may include but is not limited to metal, carbon fiber, plastic, and the like. Furthermore, umbrella coupling body 21 may be of a cylindrical shape to cooperate with the shape of umbrella 70. It should be understood that umbrella coupling body 21 may be made of any suitable shape that cooperates with that of umbrella 70. Upper umbrella coupling aperture 22 is disposed on a top end of umbrella coupling body 21. Additionally, upper umbrella coupling aperture 22 is configured to receive umbrella 70 therein. In the present embodiment, upper umbrella coupling aperture 22 is of a suitable diameter to receive umbrella 70 therein. Upper umbrella coupling aperture 22 further includes a locking mechanism 24 therein configured to lock umbrella 70 to umbrella coupling body 21. Locking mechanism 24 may be any suitable locking mechanism known in the art. Lower aperture 26 is disposed on a bottom end of umbrella coupling body 21. In the present embodiment, lower aperture 26 is of a suitable diameter to receive ground spike assembly 40 therein. Lower aperture 26 further includes a threaded spike advancing mechanism housing 28. Threaded spike advancing mechanism housing 28 houses gear assembly 60 therein and is communicably mounted to a hand crank 29. Hand crank 29 is disposed on the top end of the outer portion of umbrella coupling body 21. Hand crank 29 may be made of any suitable material such as metal, plastic and the like. In the present embodiment, a user applies a force to hand crank 29 to actuate gear assembly 60 therein. The umbrella coupling body 21 includes an upper lip 21A located at a topmost end of the umbrella coupling body having a diameter greater than a diameter of the umbrella coupling body 21. The umbrella coupling body 21 further includes a bottom lip 21B located at a bottom most end of the umbrella coupling housing 21, which has a diameter less than the diameter of the upper lip 21A. The upper lip 21A also includes a support member 21C extending perpendicularly therefrom, the support member 21C having a T-shape configuration.

Ground spike assembly 40 includes a ground spike body 42 having an outer portion 42A and a tapered end 42B. In the present embodiment, ground spike body 42 may be made of any suitable material to be protected against strong winds. This may include materials such as but not limited to plastic, metal, and the like. Tapered end 42B is disposed on a bottom end of ground spike body 42. Additionally, tapered end 42B aids a user in securing ground spike body 42 to ground surface 90. Ground spike body 42 further includes threads 44 disposed on outer portion 42A of ground spike body 42. Threads 44 aid further aid a user in securing ground spike body 42 to ground surface 90. Additionally, threads 44 are received by threaded spike advancing mechanism 28. In the present embodiment, a user mounts ground spike assembly 40 onto a ground surface 90. Ground surface 90 may be a surface of sand disposed on a beach environment. Afterwards, a user then mounts umbrella coupling unit assembly 20 onto ground spike assembly 40. Lower aperture 26 receives a top end of ground spike body 42 therein. Once received, a user may then apply a force to hand crank 29 to actuate threaded spike advancing mechanism 28. This configuration allows a user to efficiently and securely mount umbrella coupling unit assembly 20 to ground spike assembly 40. Umbrella 70 is then securely mounted into upper umbrella coupling aperture 22. Umbrella anchoring system 10 provides a user with a safe and secure method of mounted an umbrella 70 to a ground surface 90.

Gear assembly 60 including a first gear 62 and a second gear 66 housed within threaded spike advancing mechanism housing 28. In one embodiment, first gear 62 is mounted in a horizontal position within threaded spike advancing mechanism housing 28. Additionally, first gear 62 and second gear 66 may be of a slanted gear type such as a straight bevel gear box or a spiral level gear box. It should be understood that any suitable gear mechanism may be used for first gear 62 and second gear 66. First gear 62 further includes an opening 63 located at a center portion of first gear 62. Additionally, opening 63 may be a circular opening of a suitable diameter to receive a top end of ground spike body 42. Furthermore, opening 63 may also include inner threads 64 located along an inner surface area of first gear 62. Opening 63 receives ground spike body 42 therein and outer threads 44 of ground spike body 42 communicably attach to inner threads 64 of first gear 62. In one embodiment, second gear 66 is mounted in a perpendicular position to first gear 62 and is integrally attached to hand crank 29. Additionally, second gear 66 may be of a smaller gear ratio than that of first gear 62. Other embodiments may include first gear 62 and second gear 64 having the same gear ratio. In one embodiment a user may turn hand crank 29 to then actuate second gear 66 which in turn will then turn first gear 62. As first gear 62 begins to turn ground spike body 42 is then pushed within ground surface 90. Gear assembly 60 provides the optimal method for inserting ground spike body 42 within ground surface 90.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An umbrella anchoring system, comprising:

a. an umbrella coupling unit assembly, including an umbrella coupling body having an upper umbrella coupling aperture, wherein an umbrella is received therein by said umbrella coupling aperture, said umbrella coupling unit assembly further including a locking mechanism disposed within said umbrella coupling aperture configured to securely lock said umbrella, said umbrella coupling unit assembly further including a lower aperture, said lower aperture including a threaded spike advancing mechanism housing therein attached to a hand crank disposed on an outer portion of said umbrella coupling unit assembly, wherein said hand crank extends outwardly from said threaded spike advancing mechanism housing, wherein said threaded spike advancing mechanism housing is a rectangular hollow member which extends outwardly from a lateral sidewall of said umbrella coupling body, wherein said umbrella coupling body includes an upper lip located at a top most end of the umbrella coupling body having a diameter greater than a diameter of said umbrella coupling body, said umbrella coupling body further including a bottom lip located at a bottom most end of the umbrella coupling housing, which has a diameter less than the diameter of said upper lip, said upper lip including a support member extending perpendicularly therefrom, said support member having a T-shape configuration, said hand crank being located entirely below said support member and entirely above said bottom lip;

b. a ground spike assembly, including a ground spike body having an outer portion, wherein said outer portion includes threads mounted thereon; and c. a gear assembly housed within said threaded spike advancing mechanism housing, wherein said gear assembly includes a first gear and a second gear, wherein said first gear is mounted horizontally within said threaded spike advancing mechanism housing, wherein a rear portion of said first gear partially extends into the threaded spike advancing mechanism housing, wherein said first gear further includes an opening having an inner surface area, wherein said inner surface area includes threads therein, wherein said opening receives a top end of said ground spike body, wherein said second gear is perpendicular mounted to said first gear and integrally mounted to said hand crank, wherein said second gear is a smaller gear than said first gear, wherein a user actuates said hand crank to then actuate said second gear which in turn actuates said first gear, wherein as said first gear is turned said ground spike body is pushed within a ground surface.

2. The umbrella anchoring system of claim 1 wherein said umbrella coupling body is of a cylindrical shape.

3. The umbrella anchoring system of claim 1 wherein the ground spike body is inserted into a ground surface, said ground surface adapted to being a surface of sand.

4. The umbrella anchoring system of claim 3 wherein said ground spike body protrudes outwardly from said ground surface a predetermined amount.

5. The umbrella anchoring system of claim 1 wherein said upper umbrella coupling aperture is of a suitable diameter to receive said umbrella therein.

6. The umbrella anchoring system of claim 1 wherein said lower aperture is of a suitable diameter to receive said ground spike body therein.

7. The umbrella anchoring system of claim 1 wherein said hand crank is disposed on an upper portion of said umbrella coupling body.

8. The umbrella anchoring system of claim 1 wherein said ground spike body includes a tapered end disposed thereon.

9. An apparatus for anchoring umbrellas, consisting of:

a. an umbrella coupling unit assembly, including an umbrella coupling body having an upper umbrella coupling aperture, wherein said umbrella coupling body comprises a cylindrical shape, wherein an umbrella is received therein by said umbrella coupling aperture, wherein said umbrella coupling aperture is of a suitable diameter to receive said umbrella therein, said umbrella coupling unit assembly further including a locking mechanism disposed within said umbrella coupling aperture configured to securely lock said umbrella, said umbrella coupling unit assembly further including a lower aperture, said lower aperture including a threaded spike advancing mechanism housing therein mounted to a hand crank disposed on an outer portion of said umbrella coupling unit assembly, wherein said hand crank extends outwardly from said threaded spike advancing mechanism housing, wherein said threaded spike advancing mechanism housing is a rectangular hollow member which extends outwardly from a lateral sidewall of said umbrella coupling body, wherein said umbrella coupling body includes an upper lip located at a top most end of the umbrella coupling body having a diameter greater than a diameter of said umbrella coupling body, said umbrella coupling body further including a bottom lip located at a bottom most end of the umbrella coupling housing, which has a diameter less than the diameter of said upper lip, said upper lip including a support member extending perpendicularly therefrom, said support member having a T-shape configuration, said hand crank being located entirely below said support member and entirely above said bottom lip;

b. a ground spike assembly, including a ground spike body having an outer portion, wherein said outer portion includes threads mounted thereon, wherein said ground spike body further includes a tapered end disposed thereon, wherein said ground spike body is inserted into a ground surface, wherein said ground spike body protrudes outwardly a predetermined amount from said ground surface, wherein said ground surface is a sand surface; and c. a gear assembly housed within said threaded spike advancing mechanism housing, wherein said gear assembly includes a first gear and a second gear, wherein said first gear is mounted horizontally within said threaded spike advancing mechanism housing, wherein a rear portion of said first gear partially extends into the threaded spike advancing mechanism housing, wherein said first gear further includes an opening having an inner surface area, wherein said inner surface area includes threads therein, wherein said opening receives a top end of said ground spike body, wherein said second gear is perpendicular mounted to said first gear and integrally mounted to said hand crank, wherein said second gear is a smaller gear than said first gear, wherein a user actuates said hand crank to then actuate said second gear which in turn actuates said first gear, wherein as said first gear is turned said ground spike body is pushed within said ground surface.

* * * * *